United States Patent [19]

Sheu

[11] Patent Number: 4,944,622

[45] Date of Patent: Jul. 31, 1990

[54] WRITING IMPLEMENT

[76] Inventor: Tyng-Jen Sheu, 3, 11F-7, Fu-Shin 2nd Rd., Lin-Ya Dist. Kaohsiung, Taiwan

[21] Appl. No.: 325,697

[22] Filed: Mar. 16, 1989

[51] Int. Cl.[5] ..... B43K 24/10; B43K 24/14; B43K 24/16; B43K 24/18

[52] U.S. Cl. ..... 401/90; 401/56; 401/57

[58] Field of Search ..... 401/56, 57, 90, 89

[56] References Cited

U.S. PATENT DOCUMENTS

| | | | |
|---|---|---|---|
| 2,219,769 | 10/1940 | Dorfman | 401/90 |
| 2,483,103 | 9/1949 | Raimondi | 401/90 |
| 2,491,254 | 12/1949 | Dorfman | 401/90 |
| 2,518,932 | 8/1950 | Raimondi | 401/90 |
| 2,596,234 | 5/1952 | Gartenmann | 401/56 |
| 3,424,535 | 1/1969 | Schischkow | 401/57 |

FOREIGN PATENT DOCUMENTS

| | | | |
|---|---|---|---|
| 807909 | 7/1951 | Fed. Rep. of Germany | 401/90 |
| 910971 | 6/1946 | France | 401/90 |
| 945708 | 5/1949 | France | 401/90 |
| 248820 | 5/1947 | Switzerland | 401/90 |
| 265222 | 11/1949 | Switzerland | 401/90 |

*Primary Examiner*—Steven A. Bratlie
*Attorney, Agent, or Firm*—Harness, Dickey & Pierce

[57] ABSTRACT

This invention relates to a writing implement including an elongated tube having an upper open end and a lower end in which a clamping device and a propelling device are mounted, as well as a central bore extended from the upper open end to the clamping device. The central bore of the elongated tube includes an upper section as well as a lower section the diameter of which is smaller than that of the upper section. The lower section is provided with a plurality of radial grooves extended from the lower section for the purpose of receiving the leads. A lead supplying rod is rotatably fitted in the lower section of the central bore. The lead supplying rod has a through bore connected with the clamping device and a slot radially extended from the through bore thereof. The slot of the lead supplying rod communicates with one of the grooves of the tube and permits the leads to singly enter the through bore. Therefore, many leads can be received in the grooves of the tube and can respectively enter the through bore of the lead supplying rod via the slot of the lead supplying rod when the lead supplying rod is rotated to make the slot of the lead supplying rod respectively communicate with the grooves of the tube.

1 Claim, 3 Drawing Sheets

WRITING IMPLEMENT

BACKGROUND OF THE INVENTION

This invention relates to a writing implement for use with leads which are propelled, for writing purposes, by a propelling means mounted near the lower end of the writing implement, and more particularly to a writing implement which has a magazine with a lead supplying means which can receive spare leads.

In the prior art, writing implements, such as automatic pencils, commonly have clamping means mounted in the lower end thereof, a propelling means associated with said clamping means and a single inner tube connected with said clamping means. The propelling means has a retractable lower portion protruding out from the lower end of the pencil. A lead in the inner tube will drop into the propelling means and will be clamped by said clamping means. By depressing the lower portion of said propelling means into the lower end of the pencil and then letting said lower portion spring back to its original position, said lead may be released from the clamping means so that one end thereof protrudes from the lower end of the pencil for writing purposes. Such an automatic pencil is very convenient to use. However, because the inner tube of such an automatic pencil can only receive one or two leads, a user must frequently supply leads thereto.

SUMMARY OF THE INVENTION

It is therefore a main object of this invention to provide a writing implement with a clamping and a propelling means mounted near the lower end thereof which can receive many leads so that the frequent supplying of leads is not required.

Accordingly, a writing implement of this invention includes an elongated tube having an upper open end and a lower end in which a clamping means and a propelling means are mounted, as well as a central bore extended from the upper open end to the clamping means. The central bore of the elongated tube includes an upper section as well as a lower section the diameter of which is smaller than that of the upper section. The lower section is provided with a plurality of radial grooves extended from the lower section for the purpose of receiving the leads. A lead supplying rod is rotatably fitted in the lower section of the central bore. The lead supplying rod has a through bore connected with the clamping means and a slot radially extended from the through bore thereof. The slot of the lead supplying rod communicates with one of the grooves of the tube and permits the leads to singly enter the through bore. Therefore, many leads can be received in the grooves of the tube and can respectively enter the through bore of the lead supplying rod via the slot of the lead supplying rod when the lead supplying rod is rotated to make the slot of the lead supplying rod respectively communicate with the grooves of the tube.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF A PREFERRED EMBODIMENT

Figure 1:
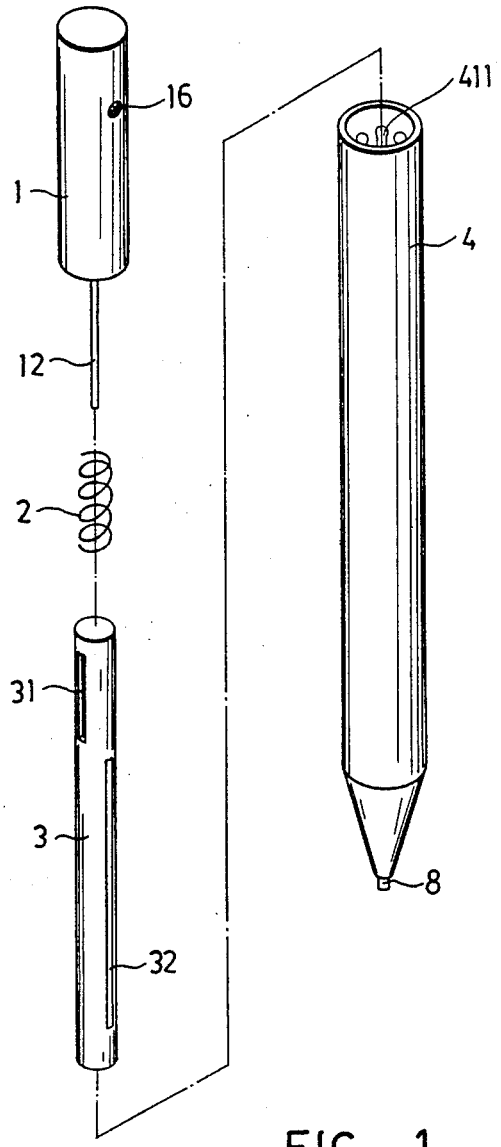
FIG. 1 is a exploded perspective view of a preferred embodiment of an automatic pencil of this invention.

Referring to FIG. 1, an exploded view of a preferred embodiment of an automatic pencil of this invention is shown. The automatic pencil includes an elongated tube 4 having an upper open end and a cone-shaped lower end, a cylindrical push member 1 slidably and rotatably mounted in the upper open end of the tube 4, a lead supplying rod 3 slidably connected with said push member 1, and a spring 2 fixed between the push member 1 and the lead supplying rod 3 which is biased to urge the push member 1 to an upward protruding position. A clamping device and a propelling device are installed in the tube 4 near the lower end of the same in a conventional way (see FIG. 5) for the purpose of protruding a piece of lead from the lower end of the tube 4 in a manner that will be described later.

Figure 2:
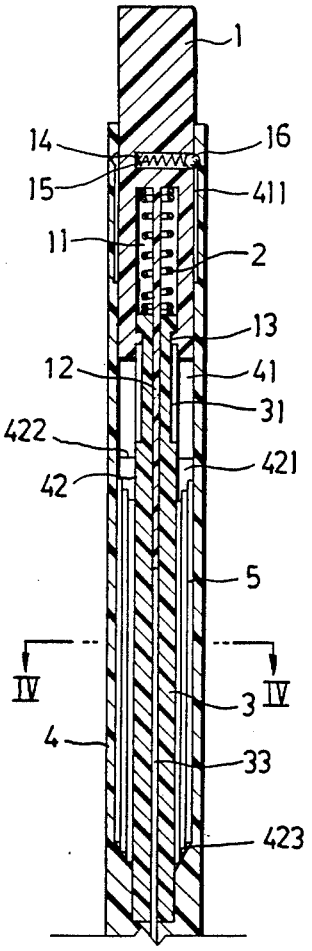
FIG. 2 is a fragmented sectional view of a preferred embodiment of an automatic pencil of this invention.
Figure 3:
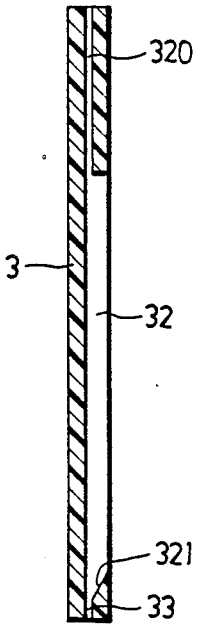
FIG. 3 is a sectional view of a lead supplying rod of an automatic pencil of this invention.
Figure 4:
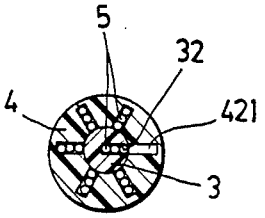
FIG. 4 is a cross section view taken along the line IV—IV in FIG. 2.

Referring to FIG. 2, a fragmented sectional view of the automatic pencil in FIG. 1 is shown. The tube 4 has a central bore consisting of an upper section 41 and a lower section 42 which is of a smaller diameter than that of the upper section 41. A plurality of positioning slots 411 are axially formed around the inner surface of the tube 4 near the upper open end of the same. A plurality of radial grooves 421 are extended from the lower section 42 of the central bore and correspondingly aligned with the positioning slots 411 for the purpose of receiving leads 5. Each groove 421 has an upper end 422 communicating with the upper section 41 of the central bore and a lower end bounded by an inclined inner face 423. The inclined inner surfaces 423 converge toward the lower end of the lower section 42 of the central bore. The lead supplying rod 3 has a through bore 33 axially formed therein and a long slot 32 radially extended from said the through bore 33, as shown in FIG. 3. The lower end of the long slot 32 is preferrably bounded by an inclined face 321. The lead supplying rod 3 is fitted within the lower section 42 of the central bore with the long slot 32 communicating with one of the grooves 421 of the tube 4 and the inclined face 321 of the lead supplying rod 3 tapering downward so as to associate with the inclined inner face 423 of said one groove 421. In this respect, the leads 5 received in the grooves 421 of the tube 4 may singly enter the through bore 33 of the lead supplying rod 3 via the long slot 32 of the lead supplying rod 3, as shown in FIG. 4. The push member 1 has a cylindrical cavity 11 formed at the lower end thereof. The cavity 11 is adapted to receive the upper end of the lead supplying rod 3. Two opposite protrusions 13 radially protrude into the cavity 11 at the lower end of the push member 1 so as to slidably engage with a pair of sliding grooves 31 formed near the upper end of the lead supplying rod 3. In this way, the lead supplying rod 3 can be rotated along with the push member 1. A push rod 12 is extended from the bottommost cavity 11 into the through bore 33 of the lead supplying rod 3 so as to push a lead 5 received in the through bore 33 into the clamping device when the push member 1 is depressed. The push member 1 also has a mounting hole 14, radially formed near the upper open end of the tube 4, in which a coiled spring 15 and a ball 16 are received. The ball 16 is biased by the coiled spring 15 so as to engage with one of the positioning slots 411 of the tube 4. Therefore, the push member 1 can be positioned between a first position where said push member 1 protrudes upward and a second position where the push rod 12 pushes the lead 5 received in the through bore 33 into the clamping device.

Figure 5:
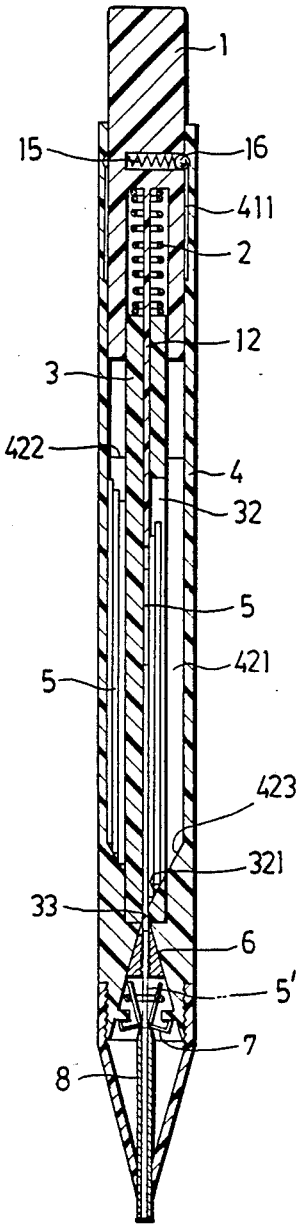
FIG. 5 is a sectional view of a preferred embodiment of an automatic automatic pencil of this invention, in which a piece of lead is received in the through bore of the lead supplying rod.

Referring to FIG. 5, the long slot 32 of the lead suppling rod 3 may be rotated to communicate with an adjacent groove 421 of the tube 4 by manually rotating the push member 1 several degrees from one to another of the positioning slots 411. By this action, the leads 5 received in said adjacent groove 421 may slip into the long slot 32 of the lead supplying rod 3, after which one of the leads 5' in said long slot 32, (which is shown by the phantom line), may enter the through bore 33 of the lead supplying rod 3 and be pushed into the clamping device when the push member 1 is depressed. The clamping device includes a preventing member 6 for preventing the piece of lead 5' in the through bore 33 from moving upward and a clip member 7 for clamping the piece of lead 5'. The propelling device includes a retractable pipe 8 having an upper end connected with the clip member 7 and a lower end protruding out from the lower end of tube 4. By depressing the lower end of the retractable pipe 8 into the tube 4 and letting it protrude out again, the piece of lead 5' can be temporarily released so as to purtrude out from the lower end of the retractable pipe 8 for writing purposes. It is to be understood that the clamping device and the propelling device are not the subject matters of this invention.

With this invention thus explained, it is apparent that numerous modifications and variations can be made without departing from the scope and spirit of this invention. It is therefore intended that this invention be limited only as indicated in the appended claims.

I claim:

1. A writing implement comprising:

an elongated tube having an upper open end and a lower end in which a clamping means is mounted, a propelling means associated with said clamping means having a retractable lower portion protruding out from said lower end of said tube, a central bore extended from said upper open end to said clamping means, said clamping means being adapted to clamp leads coming from said central bore and prevent said leads from moving toward said central bore, said propelling means being adapted to temporarily release said clamping means and enable said leads to protrude from said retractable lower portion thereof for writing purposes by means of depressing said lower portion of said propelling means into said lower end of said tube and then letting said lower portion spring back to its original position; wherein the improvement is characterized in that said tube has a plurality of positioning slots axially formed around an inner surface thereof near said upper open end, each positioning slot having an upper and a lower end of a predetermined length, and said central bore of said elongated tube includes an upper section as well as a lower section the diameter of which is smaller than that of said upper section, said lower section having a lower end connected with said clamping means, and a plurality of radial grooves extended from said lower section correspondingly aligned with said positioning slots for receiving said leads, each of said grooves having an upper end communicating with said upper section and a lower end bounded by an inclined inner face of said tube, said inclined inner faces converging toward said lower end of said lower section;

a lead supplying rod having an upper and lower end in which a through bore is axially formed, said lower end of said lead supplying rod being fitted within said lower section of said central bore of said tube and connected with said clamping means so that said leads can pass through said through bore of said lead supplying rod into said clamping means, said lead supplying rod having a slot radially extended from said through bore thereof communicating with one of said grooves of said tube so as to permit said leads to singly enter said through bore thereof via said slot of said lead supplying rod and a first engaging member formed near said upper end thereof, said first engaging member including a pair of opposite sliding grooves;

an elongated cylindrical body with an upper end and a lower end having a cylindrical cavity formed therein, said cavity being adapted to receive said upper end of said lead supplying rod, said elongated cylindrical body having a second engaging member including two opposite protrusions radially protruding into said cavity of said cylindrical body, said protrusions being adapted to slidably engage with respective of said sliding grooves of said first engaging member of said lead supplying rod so that said lead supplying rod can be rotated along with said elongated cylindrical body, and a push rod extended from the bottommost cylindrical cavity into said through bore of said lead supplying rod so as to push a lead received in said through bore into said clamping means when said elongated cylindrical body is depressed, said elongated cylindrical body having a mounting hole radially formed near said upper end thereof, said mounting hole having a spring and a ball received therein, said ball being biased by said spring so as to engage with one of said positioning slots formed near said upper open end of said tube allowing said elongated cylindrical body to be placed between a first position where said elongated cylindrical body protrudes upward and a second position where said push rod of said elongated cylindrical body pushes the lead received in said through bore into said clamping means; and a spring member mounted between said upper end of said lead supplying rod and the bottommost cylindrical cavity which urges said elongated cylindrical body to an upward protruding position; whereby said slot of said lead supplying rod may be rotated to communicate with an adjacent groove of said tube by manually rotating said elongated cylindrical body several degrees from one to another of said positioning slots and said lead in said grooves can enter said through bore of said lead supplying rod and be pushed into said clamping means when said elongated cylindrical body is depressed.

* * * * *